United States Patent [19]

Gailey

[11] Patent Number: 4,621,568

[45] Date of Patent: Nov. 11, 1986

[54] ROTARY HYDRAULIC CYLINDER

[75] Inventor: Edward D. Gailey, Mentor, Ohio

[73] Assignee: The S-P Manufacturing Corporation, Cleveland, Ohio

[21] Appl. No.: 676,795

[22] Filed: Nov. 30, 1984

[51] Int. Cl.[4] ..... F01B 31/00

[52] U.S. Cl. .....92/106; 384/276; 384/295; 384/624; 279/4

[58] Field of Search ..... 92/106; 308/1 A, 1 R; 384/276, 295; 279/4 R

[56] References Cited

U.S. PATENT DOCUMENTS

| | | | |
|---|---|---|---|
| 2,536,565 | 1/1951 | Ostergren | 92/106 |
| 2,646,036 | 7/1953 | Allyn et al. . | |
| 2,873,628 | 2/1959 | Stuart . | |
| 2,880,009 | 3/1959 | Gamet | 92/106 |
| 3,020,057 | 2/1962 | Gamet . | |
| 3,179,428 | 4/1965 | Cull . | |
| 3,417,672 | 12/1968 | Sampson . | |
| 3,439,925 | 4/1969 | Sampson . | |
| 3,483,774 | 12/1969 | Dickmann et al. . | |
| 3,922,952 | 12/1975 | Roddy et al. . | |
| 3,923,133 | 12/1975 | Chivari . | |
| 3,954,275 | 5/1976 | Pickles . | |
| 3,977,213 | 8/1976 | Spencer et al. . | |
| 3,986,437 | 10/1976 | Lioux . | |
| 4,007,943 | 2/1977 | Scharfen et al. . | |
| 4,040,338 | 8/1977 | Wilson et al. | 308/1 A |
| 4,249,451 | 2/1981 | Moal | 92/106 |
| 4,296,658 | 10/1981 | Champeau et al. . | |

FOREIGN PATENT DOCUMENTS 904720 1/1968 Canada.

*Primary Examiner*—Robert E. Garrett
*Assistant Examiner*—Mark A. Williamson
*Attorney, Agent, or Firm*—Watts, Hoffmann, Fisher & Heinke

[57] ABSTRACT

A rotary hydraulic cylinder for actuating a rotary work holder, on a machine tool. A non-rotary fluid distributor is supported on the cylinder by a bearing sleeve. The bearing surface of the sleeve has an anti-friction coating. The sleeve is rotatable within a housing and is frictionally restrained from rotation under normal operating conditions by O-rings, but can rotate in the event of bearing seizure. Sleeve rotation is sensed through a proximity switch to stop operation of the machine tool.

15 Claims, 5 Drawing Figures

ROTARY HYDRAULIC CYLINDER

DESCRIPTION

1. Technical Field

This invention relates to a horizontal rotary hydraulic cylinder for actuating a rotary work holder of a machine tool.

2. Background Art

Certain types of machine tools, such as lathes, utilize a rotary hydraulic cylinder to actuate a rotating, work-clamping, chuck or collet. A common arrangement is to mount a work holding chuck on one end of a driven rotary spindle that is supported in the housing of a machine tool. Conventionally, each end of the spindle extends from the housing. A hydraulic cylinder containing an axially movable piston is attached to the other end of the spindle from the chuck. Both the chuck and the cylinder rotate with the spindle. The movable piston of the hydraulic cylinder is connected by an actuator tube or rod extending through the spindle to a draw cam or collet of the work holding chuck. Fluid introduced into the rotary cylinder moves the piston and the connected actuator tube or rod in an axial direction relative to the spindle to actuate the work clamping member to hold or release the work. Fluid from a source external to the hydraulic cylinder under pressure is supplied to the cylinder as it rotates with the spindle and work holder, to move and hold the piston in one of two terminal positions.

It will be apparent that it is advantageous to utilize as large a piston as possible to obtain maximum power for holding the work with a given fluid pressure. In many instances, however, the construction of the machine tool with which the hydraulic cylinder is used imposes limitations on the diameter of the cylinder, and in any event a small diameter, compact, economical unit is desirable. It is also important that the unit not generate so much heat that high temperature gradients are applied to the machine tool spindle during operation, because accuracy in the machining operation will be lost. This can be a significant problem at relatively high rotational speeds.

U.S. Pat. Nos. 3,417,672 and 3,439,925 disclose rotary hydraulic cylinder structures in which a stationary fluid distributor is supported on a rotary cylinder by hydrostatic pressure in pressure zones provided by peripherally spaced cavities in the fluid distributor bearing wall. This provides a compact unit and facilitates high rotational speeds. However, the structures are relatively expensive to manufacture and require substantial clearances and flow rates of hydraulic fluid for cooling the structure.

DISCLOSURE OF INVENTION

The present invention relates to an improved rotary hydraulic cylinder and stationary fluid distributor that is compact, economical to fabricate, eliminates the need for roller bearings or cavities for creating hydrostatic pressure zones, generates less heat during operation than the hydrostatic bearing structures disclosed in the aforementioned patents, facilitates high rotational speed of the rotary cylinder, and in the event of a bearing seizure, provides a safeguard against rotation of the stationary fluid distributor. These features are achieved through a so-called "plain bearing" sleeve carried by the fluid distributor that directly encircles a cylindrical periphery associated with the rotary cylinder. The sleeve is frictionally retained in a housing of the fluid distributor in a manner that permits relative rotation between the two in the event rotary forces exerted on the sleeve by the rotating cylinder significantly exceed those expected during normal operation and before the forces reach a magnitude that could cause the distributor to rotate against the resistance exerted by its connected stationary conduits that supply hydraulic fluid. The sleeve and the encircled periphery associated with the rotary cylinder are coated on their bearing surfaces with an anti-friction material, specifically an epoxy-containing tetrafluoroethylene compound, that facilitates high relative rotational speeds between the sleeve and rotary cylinder and a small bearing gap; i.e., with a bearing gap between the encircling surface of the distributor and the supporting cylindrical surface associated with the rotary cylinder substantially smaller than the corresponding gap utilized in the hydrostatic bearing structure of the aforementioned U.S. patents. This smaller gap is possible because of reduced friction-generated heat occasioned by the present construction and the accompanying ability to adequately cool the bearing structure with lower flow rates of hydraulic fluid between the bearing surfaces.

In a preferred arrangement, the present invention is embodied in a fluid distributor for a rotary hydraulic motor that operates an actuator of a rotary work holder, the distributor including a rotatable cylindrical wall through which conduits extend to communicate with the hydraulic motor for operating the work holder, at least a portion of the cylindrical wall forming a bearing surface, a stationary housing surrounding the wall, a sleeve within the housing having a bearing surface surrounding that of the cylindrical wall, two axially spaced peripheral grooves at the bearing surfaces, a fluid inlet and outlet in the housing each communicating with one of the two grooves, said conduits each communicating with one of the spaced grooves, a low friction chemical coating forming at least one of the bearing surfaces, and means to frictionally restrain rotation of the sleeve relative to the housing, the sleeve being otherwise free to rotate within the housing.

The invention further includes a sensor in noncontacting relationship to the bearing sleeve for detecting relative rotation between the sleeve and surrounding housing and to cut-off power to the machine tool spindle in the event of such relative rotation. Advantageously rotation of the sleeve is frictionally resisted by elastomeric seals between the sleeve and housing and sensing of relative rotation is accomplished with a proximity switch.

The above and other features and advantages of the invention will become better understood in connection with the accompanying drawings and the description of a preferred embodiment that follows.

BEST MODE FOR CARRYING OUT THE INVENTION

Figure 1:
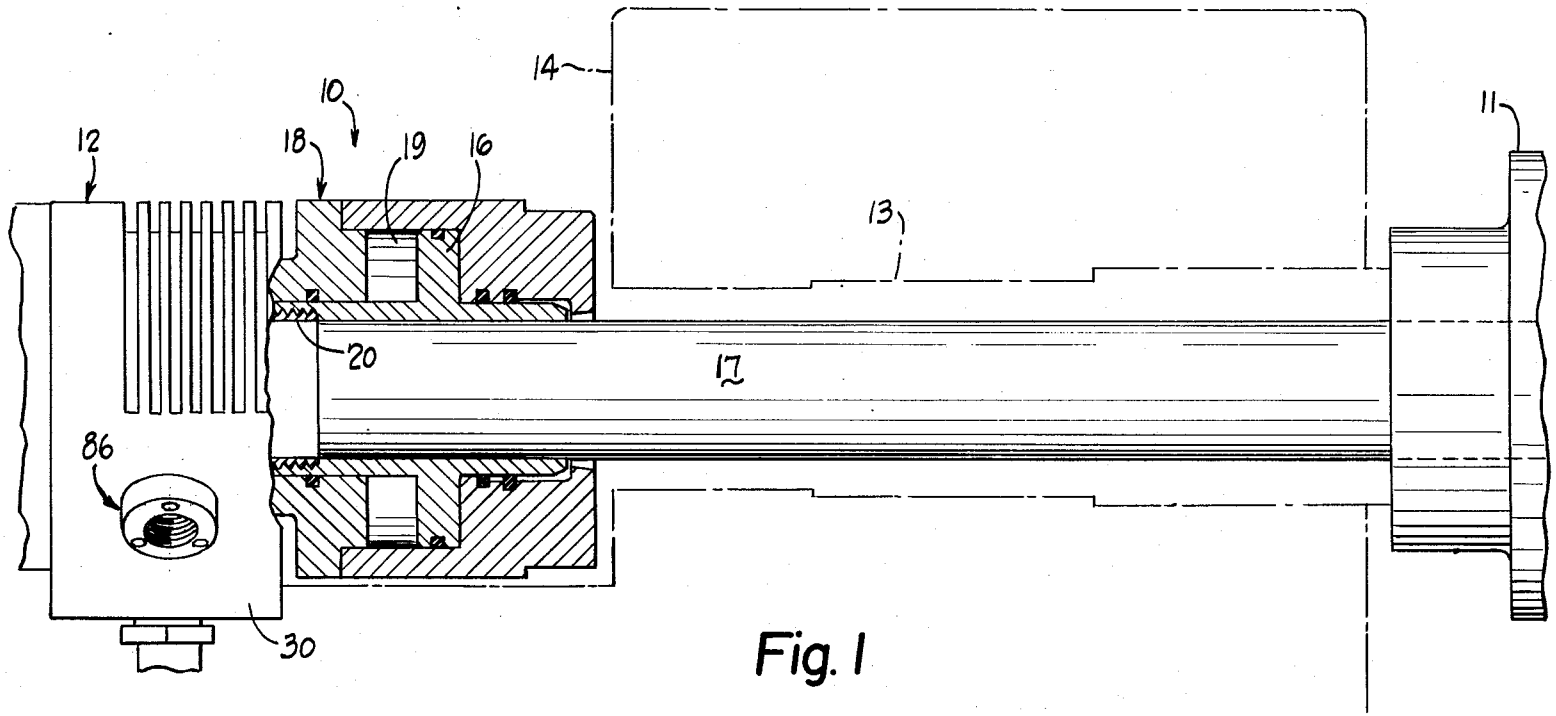
FIG. 1 is an elevational view, partly in section, diagrammatically showing the relationship of a rotary spindle of a machine tool, a work holder and a rotary hydraulic cylinder and fluid distributor embodying the present invention.

Referring now to the drawings, there is shown a rotary hydraulic cylinder 10 and stationary oil supply distributor 12 surrounding a portion of the cylinder. The cylinder 10 is mounted on a spindle 13 of a machine tool 14 with the axis of rotation of the cylinder 10 in a horizontal plane coinciding with that of the spindle. Within the cylinder 10, mounted for axial movement, is an annular piston 16. The annular piston 16 is rotatable with and axially movable relative to the rotating cylinder 10. The rotary hydraulic cylinder 10 is adapted to rotate with the spindle 13 and a work holding device 11 of the machine tool 14. Such a work holding device may be a conventional chuck or collet type work holder. An actuating tube 17 is carried within the spindle 13 and is attached to the annular piston 16 by a tube coupling 20. Axial movement of the piston 16 and the attached tube 17 actuates the work holding device in a manner well known in the art. In the embodiment shown, the cylinder and actuating tube provide a central passage for receiving an elongated workpiece to be clamped by the work holder.

With more particular reference now to the rotary hydraulic cylinder 10, there is provided a cylinder wall 18 having three portions, 18*a*, 18*b* and 18*c*. The wall portion 18*a* is of smaller diameter than wall portion 18*b*, and the two are connected by annular wall portion 18*c*. The wall portion 18*a* is housed for rotation within the distributor 12. The wall portion 18*b*, external to the distributor 12, provides a cylinder wall for the piston 16 and together with the annular wall portion 18*c* and an annular cylinder end wall 22, defines a chamber 19 for the piston 16. The distributor 12 is retained on the cylinder by a ring 70 fastened to the cylinder wall 18 by cap screws 71.

Conduits or passageways 25 extend axially within the wall 18*a* of the rotary cylinder 10. The conduits open at one end through the annular wall portion 18*c*, in direct communication with the piston chamber 19. At the other end, each communicates to the outside through an aperture 26 in the external surface of the cylinder wall 18*a*. Axially extending conduits or passages 28 are also provided in the cylinder wall 18, peripherally spaced between conduits 25. The conduits 28 extend within wall portions 18*a*, 18*c* and 18*b*, and open through the wall 18*b* into the piston chamber 19 adjacent the cylinder wall 22. The conduits 28 communicate with the external surface of cylinder wall 18*a* through apertures 29. The apertures 26 and 29 are spaced from each other axially as well as peripherally in the cylindrical wall 18*a*.

More particular reference is now made to the distributor 12, which is formed of a cylindrical housing 30, the upper part of which has fins 31 for cooling and the lower part of which is formed with a drain 32 and drain port 33 for catching and re-circulating hydraulic fluid. The housing 30 has a cylindrical inner wall 34 with a shoulder 36 at the inner end of the wall. A ring 38 at the opposite end of the wall 34 abuts the housing 30 and extends radially inward of the wall 34, forming a shoulder 40 adjacent the outer end of the wall 34. The ring 38 is secured to the housing 30 by machine screws 42.

A bearing sleeve 44, preferably of ductile iron, lines the housing 30 between the shoulders 36, 40.

The bearing sleeve 44 extends radially inward of the shoulders 36, 40 and has an outer surface 45 that directly opposes the inner surface 34 of the housing. The sleeve is received in the housing between the shoulders and surrounded by the surface 34 with a clearance fit. The sleeve 44 has an inner surface 46 directly surrounding the wall portion 18*a* of the cylinder wall 18. The inner surface 46 and the outer surface of the wall portion 18*a* surrounded by the sleeve 44 each carry an adhered thin coating 48, 49 of anti-friction material, preferably polytetrafluoroethylene containing epoxy for hardness and wear resistance. Each coating 48, 49 has a thickness of between 0.0005 inch and 0.005 inch, and in the preferred embodiment is 0.001 inch thick. Thinner coatings lack reliability and useful life, while thicker coatings are difficult to adhere and tend to crack or craze. There is a slight clearance between the coated outside diameter of the cylinder wall 18*a* and the coated inside diameter of the sleeve 44 to allow relative rotation and to accommodate lubricant, i.e., hydraulic fluid. In a preferred embodiment of the invention, a diametral clearance of 0.0026 inch to 0.0036 inch is provided.

The bearing sleeve 44 has two longitudinally spaced circumferential grooves 52, 54 in the outside surface 45 and two longitudinally spaced circumferential grooves 56, 58 in the inner surface 46. The grooves in the outer surface are longitudinally aligned with those of the inner surface and are of equal width in the preferred embodiment. Thus, the groove 52 is longitudinally aligned with the groove 56 and the groove 54 is longitudinally aligned with the groove 58. Transverse passages 60 peripherally spaced within the sleeve 44 interconnect the groove 52 with the groove 56 and the groove 54 with the groove 58. The grooves 56 and 58 are longitudinally spaced a distance equal to the longitudinal spacing between the apertures 26 and 29 of the longitudinal conduits or passageways 25, 28 to the piston chamber 19 and the distributor is positioned so the grooves are aligned with the apertures.

Elastomeric O-rings 62 are provided in circumferential grooves 64 in the outside surface 45 of the bearing sleeve on opposite sides of each groove 52 and 54 to prevent cross flow and leakage of hydraulic fluid between the housing 30 and the sleeve. The O-rings also establish a frictional resistance to relative rotation between the sleeve 44 and the housing 30 by the engagement of the O-rings with the sleeve and the opposing surface 34. This resistance retains the sleeve in fixed relationship to the housing 30 during normal operation, but permits relative rotation of the sleeve with respect to the housing in the event substantial rotational forces are applied to the sleeve well beyond those normally experienced during operation, as for example, if the bearing were to seize so the cylinder no longer freely rotated within the sleeve. By way of example, the O-rings hold the sleeve against rotational forces of up to about 100-foot pounds of torque and then allow rotation of the sleeve within the housing, which is permitted in the absence of the O-rings by the clearance fit of the sleeve. In normal operation the sleeve experiences about 5 to 110 foot-pounds of torque.

Figure 2:
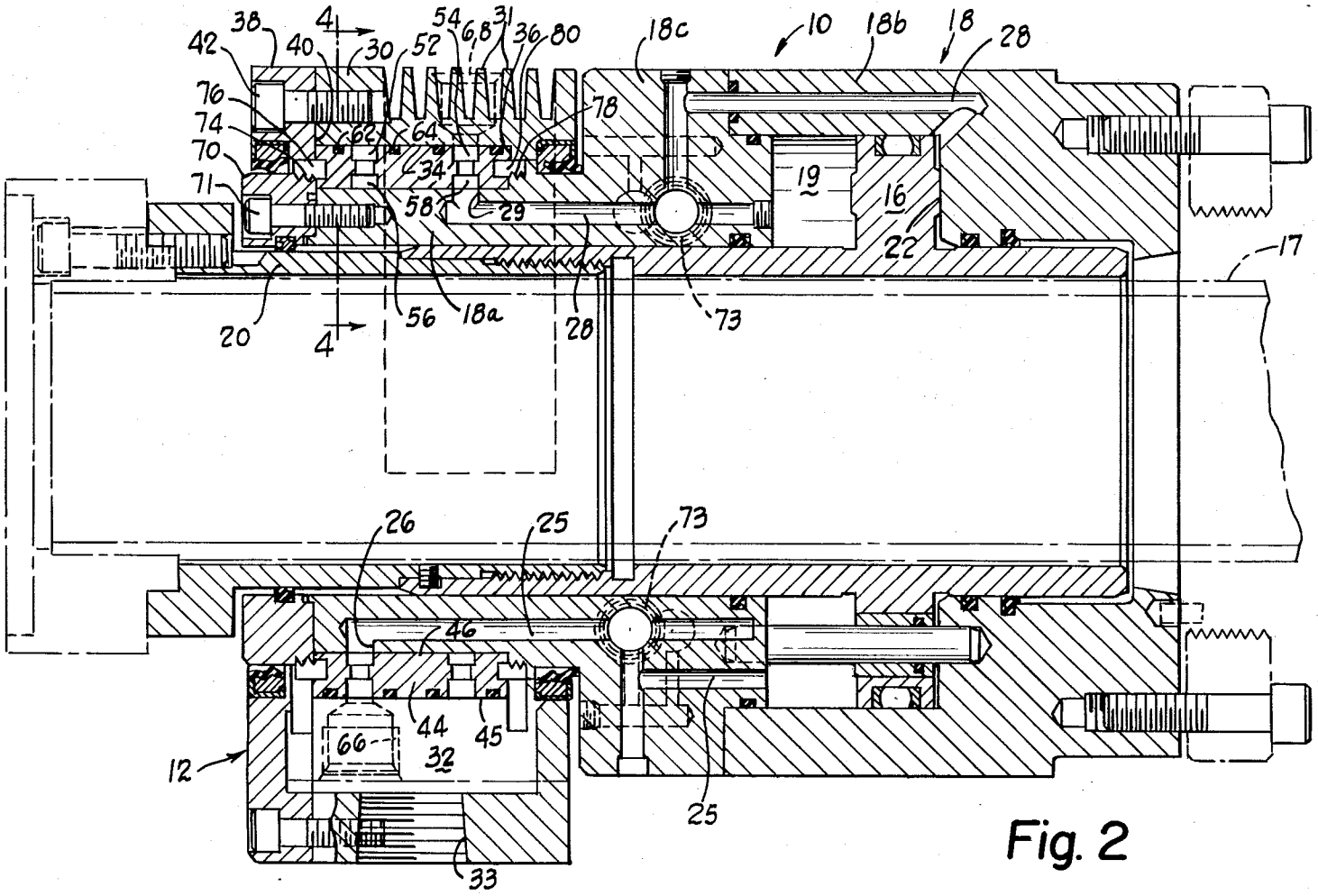
FIG. 2 is a longitudinal sectional view of a rotary hydraulic cylinder and stationary fluid distributor embodying the present invention.
Figure 3:
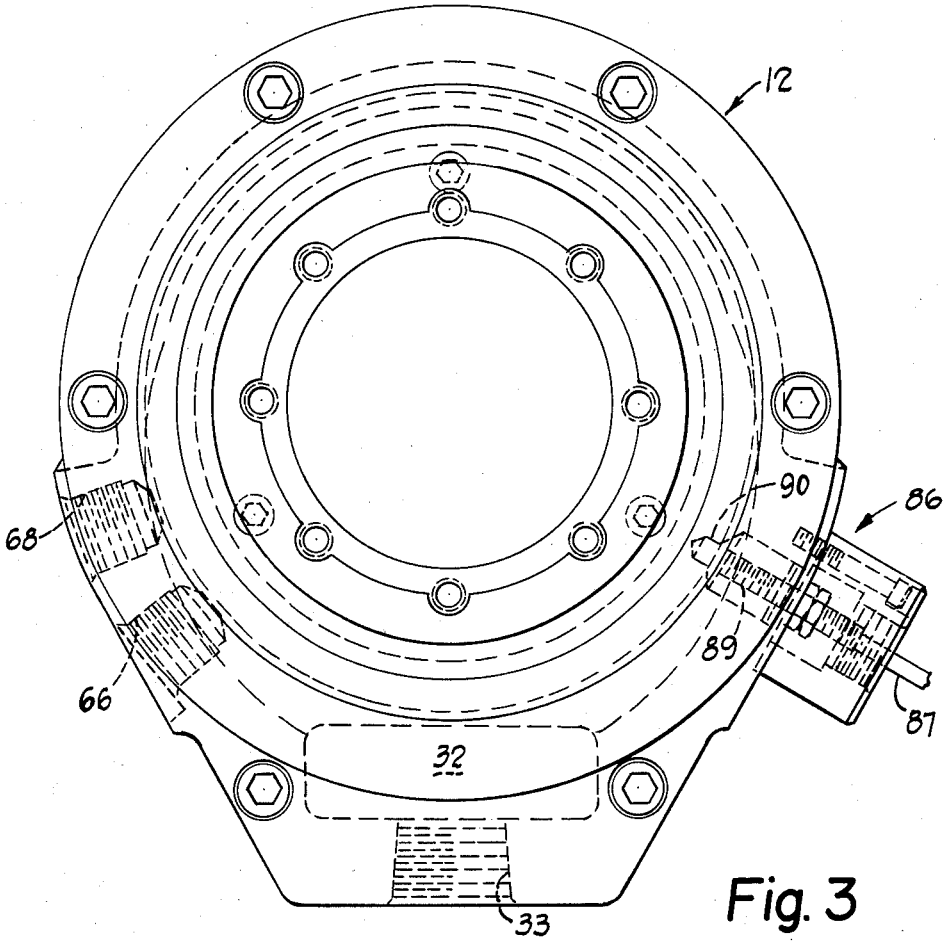
FIG. 3 is an end elevational view of the apparatus shown in FIG. 2 taken from the left side.
Figure 4:
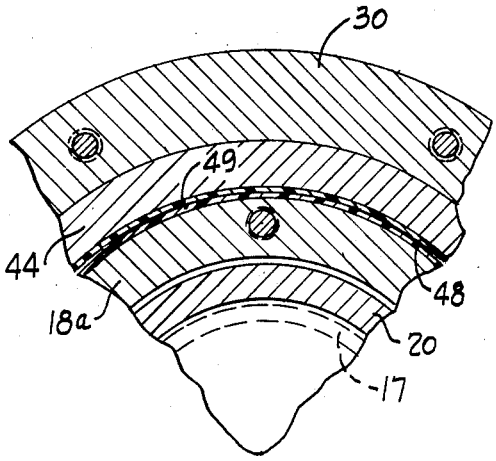
FIG. 4 is a partial transverse sectional view of the cylinder and distributor of FIG. 2 taken along the line 4—4.

Ports 66, 68 in the housing 30 communicate respectively with the grooves 52, 54. The ports are shown in phantom in FIG. 2 out of position for purposes of illustration, but are indicated in their proper position in FIG. 3. The ports are connected to conduits that communicate selectively with either a source of hydraulic fluid under pressure, or to exhaust, to facilitate operation of the piston 16. When one port 66, 68 is connected to a source of hydraulic fluid under pressure, the other is connected to exhaust. In this way, the stationary distributor 12 continuously communicates a source of hydraulic fluid under pressure to the gap between the sleeve 44 and cylinder wall 18 and also to the cylinder chamber 19. Safety check valves, as indicated at 73, serve to maintain the fluid pressure in the chamber 19 if pressure at one of the ports 66, 68 is lost without the application of pressure at the other, and thereby prevents loss of work gripping force at the holder 11 in the event of a pressure failure.

During operation of the apparatus, fluid under pressure is always supplied to one of the grooves 56, 58, and by virtue of the clearance between the sleeve 44 and cylinder wall 18*a*, hydraulic fluid flows longitudinally within the clearance gap to lubricate the bearing surfaces and acts as a coolant to carry away heat developed by the friction between the bearing surfaces during relative rotation. Flow from the groove 56 or 58 under pressure, in the axial direction centrally of the bearing surface will be intercepted and caught by the other groove 56 or 58 that is communicating with exhaust. Flow in the other axial direction will be caught by seal grooves 74 of the ring 70 at the outer end of the sleeve 44 or by seal grooves 78 in the cylindrical wall 18*a* at the inner end of the sleeve 44. A collection groove 76 in the ring 38 surrounds the seal grooves 74 and a collection groove 80 surrounds the seal grooves 78. Fluid caught on the rotating seal grooves 74, 78 is flung into the collecting grooves 76, 80 and thence flows to the drain 32.

The rotary hydraulic cylinder and non-rotary distributor combination described above is designed to facilitate bearing speeds of 3000 surface feet per minute and above and finds use with machine tools capable of rotary spindle speeds of 2000 to 4500 revolutions per minute. The bearing load due to the weight of the distributor is less than 10 pounds per square inch and in the preferred embodiment is about 2 pounds per square inch. This plain bearing structure operates at the low-load, high surface speed, part of the so-called "PV" curve of the bearing, which indicates acceptable load and surface speed combinations and is hyperbolic in shape. Because of the low bearing friction due to the coatings 48, 49 and the relatively small clearance provided by the bearing construction, which is maintained throughout the operative temperature range by virtue of similar coefficients of expansion of the ductile iron sleeve 44 and the steel cylinder 18, the spindle horsepower consumed by the rotary hydraulic cylinder is very small. By comparison, it is approximately 30 percent less than that of the hydrostatic bearing construction disclosed in the aforementioned patents and requires only about 55 percent of the flow of hydraulic fluid to provide adequate cooling, because of the reduced heat generated. The size of the gap between the bearing surfaces is selected to control this flow to restrict it to a volume suitable for both lubrication and cooling.

Figure 5:
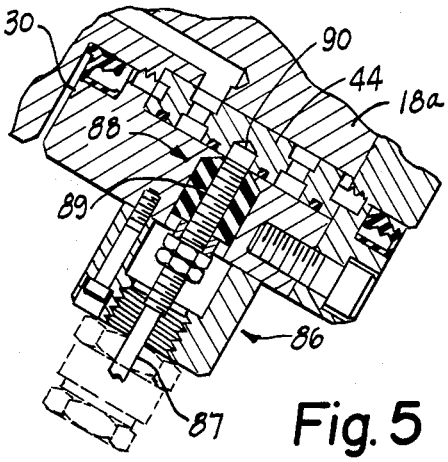
FIG. 5 is a partial longitudinal sectional view similar to FIG. 2 but through a different plane showing a rotation sensor.

A detector 86 on the housing 30 senses rotation of the bearing sleeve 44 relative to the housing and when that occurs produces an electrical signal that is carried by an electrical conduit 87 to a control that interrupts power to the spindle 13. Thus, if the bearing should seize so the cylinder 18 does not rotate freely within the sleeve 44, the frictional resistance of the O-rings 62 is overcome and the sleeve 44 rotates within the housing, which remains stationary so the hydraulic connections are not torn loose. A soon as the sleeve rotates, the change in position is sensed by the detector. In the preferred embodiment the detector is a proximity switch 88 carried by the housing, and located directly adjacent but radially outward of and not in contact with the sleeve 44. The switch is sensitive to the proximity of the metal sleeve to a sensor element 89. By virtue of a recess 90 in the outer surface 45 of the sleeve, which recess is normally positioned directly opposite the sensor, as illustrated in FIG. 5, the mass of metal sensed changes upon slight rotation of the sleeve relative to the housing and the switch is operated.

While a preferred embodiment of the invention has been disclosed in detail, various modifications or alterations can be made therein without departing from the spirit and scope of the invention set forth in the appended claims.

I claim:

1. In a rotary hydraulic cylinder for operating an actuator of a rotary work holder and having an external cylindrical bearing surface, a piston chamber within the cylinder, an axially movable piston in the chamber connected with the actuator, a non-rotary fluid distributor surrounding the bearing surface of the cylinder and having an inner cylindrical bearing surface mating therewith, two axially spaced grooves at the bearing surfaces, a fluid inlet and a fluid outlet in the fluid distributor each communicating with one of the two spaced grooves, and at least two passageways associated with the cylinder each communicating between one of the two spaced grooves and one of two opposite ends of the piston chamber, the improvement wherein the fluid distributor includes an outer housing and an inner cylindrical sleeve, the inner cylindrical bearing surface is on the cylindrical sleeve, a low-friction chemical coating is adhered to one of the bearing surfaces, and the improvement further includes means to frictionally restrain rotation of the sleeve relative to the housing against forces normally applied to the sleeve in operation, said sleeve being otherwise free to rotate within the housing.

2. A rotary hydraulic cylinder as set forth in claim 1 wherein said means to frictionally restrain the sleeve includes an elastomeric seal between the sleeve and housing.

3. A rotary hydraulic cylinder as set forth in claim 1 wherein said two axially spaced grooves are in the inner cylindrical bearing surface on the sleeve and wherein the sleeve has two additional axially spaced grooves in an outer surface that is surrounded by the housing, passageways between the grooves in the outer and inner surfaces of the sleeve, and wherein said means to frictionally retain the sleeve are elastomeric seals between the sleeve and housing.

4. A rotary hydraulic cylinder as set forth in claim 3 wherein said seals are located to prevent cross flow of hydraulic fluid between the grooves in the outer surface of the sleeve.

5. A rotary hydraulic cylinder and distributor as set forth in claim 1 including means in non-contacting relationship with the sleeve to sense and signal rotation of the sleeve relative to the housing.

6. A rotary hydraulic cylinder and non-rotary fluid distributor for operating an actuator of a rotary work holder comprising: an external cylindrical bearing surface, a piston chamber, and an axially movable piston in the chamber connected with the actuator, all rotatable with the work holder; an outer housing and an inner sleeve of ductile iron, the sleeve having an inner bearing surface surrounding the external bearing surface, two axially spaced grooves at the bearing surfaces, a fluid inlet and a fluid outlet in the fluid distributor each communicating with one of the two spaced grooves, and at least two passageways associated with the cylinder each communicating between one of the two spaced grooves and one of two opposite ends of the piston chamber, one of said bearing surfaces being an epoxy-filled polytetrafluoroethylene coating, and means frictionally restraining rotation of the sleeve relative to the housing against forces normally applied to the sleeve in operation, said sleeve being otherwise free to rotate within the housing.

7. A rotary hydraulic cylinder and distributor as set forth in claim 6 including means in non-contacting relationship with the sleeve to sense and signal rotation of the sleeve relative to the housing.

8. A rotary hydraulic cylinder and non-rotary fluid distributor for operating an actuator of a rotary workholder, and suitable for use at rotary work holder speeds of greater than 2000 revolutions per minute, said cylinder having an external cylindrical bearing surface, a piston chamber, and an axially movable piston in the chamber connected with the actuator, said fluid distributor having an outer housing an an inner sleeve of ductile iron surrounding the bearing surface of the cylinder and supported on the cylinder by the sleeve, the bearing load being less than 10 pounds per square inch, two axially spaced grooves in one of the bearing surfaces, a fluid inlet and a fluid outlet in the fluid distributor each communicating with one of the two spaced grooves, and at least two passageways associated with the cylinder each communicating between one of two spaced grooves and one of two opposite ends of the piston chamber, an epoxy-filled polytetrafluoroethylene coating of a thickness between 0.0005 inch and 0.005 inch adhered to both the inner surface of the sleeve and the surrounded surface of the cylinder, said coated sleeve surface and the coated surface of the cylinder having diametral clearances of between 0.0026 inch and 0.0036 inch, and means frictionally retaining the sleeve in the housing against relative rotation therebetween from forces applied to the sleeve in operation when the cylinder is freely rotatable within the distributor but to allow relative rotation therebetween from forces in excess of said first-mentioned forces, said sleeve being otherwise free to rotate within the housing.

9. A rotary hydraulic cylinder and distributor as set forth in claim 8 including means in non-contacting relationship with the sleeve to sense and signal rotation of the sleeve relative to the housing.

10. A rotary hydraulic cylinder and distributor as set forth in claim 9 wherein said means frictionally retaining the sleeve includes an elastomeric seal between the sleeve and housing.

11. A fluid distributor for a rotary hydraulic cylinder used to operate an actuator of a rotary work holder, comprising a rotatable cylinder wall through which conduits extend and which has an external cylindrical bearing surface, said fluid distributor having an outer housing and an inner bearing sleeve surrounding the bearing surface of the cylinder and supporting the distributor on the cylinder, said sleeve having passages for distributing hydraulic fluid to the conduits, said sleeve being rotatable relative to the housing, means frictionally restraining rotation of the sleeve relative to the housing, and means carried by the housing in noncontacting relationship with the sleeve to sense and signal rotation of the sleeve relative to the housing.

12. A cylinder and distributor as set forth in claim 11 wherein said means frictionally restraining rotation of the sleeve consists essentially of elastomeric seals between the sleeve and housing.

13. A fluid distributor for a rotary hydraulic motor used to actuate a rotary work holder of a machine tool or the like, comprising a rotatable cylindrical wall through which conduits extend axially to communicate with the hydraulic motor for operating the work holder, at least a portion of said cylindrical wall forming a first bearing surface, a stationary housing surrounding the cylindrical wall, a sleeve within said housing having a second bearing surface directly surrounding the first bearing surface and supporting the housing on the cylindrical wall, two axially spaced peripheral grooves at the bearing surfaces, a fluid inlet and a fluid outlet in the housing each communicating with one of the two spaced grooves, said conduits each communicating with one of the two spaced grooves, a low friction chemical coating forming one of said bearing surfaces, and means to frictionally restrain rotation of the sleeve relative to the housing against forces normally applied to the sleeve in operation, said sleeve being otherwise free to rotate within the housing.

14. A rotary hydraulic cylinder and distributor as set forth in claim 13 including means in non-contacting relationship with the sleeve to sense and signal rotation of the sleeve relative to the housing.

15. A rotary hydraulic cylinder and distributor as set forth in claim 14 wherein said means frictionally retaining the sleeve includes an elastomeric seal between the sleeve and housing.

* * * * *